United States Patent [19]

Boyer

[11] 4,136,618

[45] Jan. 30, 1979

[54] RAILROAD LIFTING DEVICE FOR BALLAST CLEANING AND LEVELLING MACHINES

[76] Inventor: Jean-Jacques Boyer, Montchauvet, France

[21] Appl. No.: 804,153

[22] Filed: Jun. 6, 1977

[51] Int. Cl.[2] ..... E01B 29/04; E01B 27/02; E01B 27/06

[52] U.S. Cl. ..... 104/7 R; 171/16

[58] Field of Search ..... 104/2, 7 R, 7 A, 7 B, 104/12; 171/16; 37/104, 105, 106, 107

[56] References Cited

U.S. PATENT DOCUMENTS

| | | | |
|---|---|---|---|
| 2,725,016 | 11/1955 | Fogelberg et al. | 104/7 A |
| 3,055,309 | 9/1962 | Moss | 104/7 A |
| 3,459,135 | 8/1969 | Stewart | 104/7 R |
| 3,811,382 | 5/1974 | Buchter et al. | 104/7 R |

*Primary Examiner*—Albert J. Makay
*Assistant Examiner*—Randolph A. Reese
*Attorney, Agent, or Firm*—Young & Thompson

[57] ABSTRACT

The present invention relates to the so-called ballast cleaning and levelling machines circulating on the railroad to be renovated while bearing on it by two end bogies and lifting the part of the track situated between the two bogies through lifting device. According to the invention the machine carries in front of the lifting device as such a shoe which is engaged at least under the tie ends between a point which is exterior to but neighboring the tie end and a point situated inside in relation to the tie end, and an endless cable guiding device comprising guides in the front and rear for respectively introducing one of the cable strands from the outside of the tie ends, behind the shoe, and extracting the other end of the cable strand from under the ties downstream of the lifting device and guides for maintaining the cable strand between its introduction and extraction, under the ties, at a distance from the rail upper surface which is substantially equal to the sum of the rail height and the ties thickness. The invention avoids non lifting of the ties on which rails are fixed by smooth spikes.

4 Claims, 4 Drawing Figures

RAILROAD LIFTING DEVICE FOR BALLAST CLEANING AND LEVELLING MACHINES

The present invention relates to the so-called ballast cleaning and levelling machines circulating on the railroad to be renovated while bearing on it by two end bogies and lifting the part of the track situated between the two bogies for allowing passage underneath to a transverse clearing excavator which removes the layer of old ballast and levels the platform, then to a levelling device which spreads out, levels and compresses the new ballast layer on which is laid back the old railroad, that is the rails and their ties.

In such machines, the lifting of the track is carried out either by electro-magnetic devices such for instance as those of the type described in U.S. Pat. No. 3,481,278 dated Dec. 2, 1969, or by tongs provided with rollers which are engaged under the rail head.

Such known devices provide a correct lifting of the rails and ties when the ties are sufficiently connected to the rail on which acts the lifting device so that they are extracted from the old ballast layer. This connection is generally sufficient on the tracks which are not too old and in which the rails and their rail chairs are fixed on the ties by sleeper-screws. On the contrary, in the case where the railroads in general have not been renovated since their origin and their rail tie pads are fixed by smooth spikes of the nail type as is the case in particular in the United States of America, the fixation nails have played laterally and slightly enlarged their housing, and if they are sufficient for maintaining the rails on their ties against any transverse displacement, they are easily pulled up from the ties when the railroad is being lifted with the known lifting devices.

The object of the present invention is to remedy such disadvantages and it aims at improving the known railroad lifting devices on ballast cleaning and levelling machines, according to which improvement the machine carries in front of the lifting device as such a shoe which is engaged at least under the tie ends between a point which is exterior to but neighboring the tie end and a point situated inside in relation to said end, and an endless cable guiding device comprising guiding means in the front and rear for respectively introducing one of the cable strands from the outside of the tie ends, behind the shoe, the extracting the other end of the cable strand from under the ties downstream of the lifting device and guiding means for maintaining the cable strand between its introduction and extraction, under the ties, at a distance from the rail upper surface which is substantially equal to the sum of the rail height and the ties thickness.

Preferably, the shoe has a wedge-shaped vertical cross-section for engagement under the tie between said tie and its bearing surface on the ballast by eventually crossing the ballast shoulder existing between two ties and it is carried by elements which are integral with the machine frame and extend beyond the tie ends. Preferably, the shoe is made of two lateral shoes engaged each under one tie end. Preferably, the shoe is formed in its front part with teeth of reduced width which are engaged in the ballast layer below the level of the lower ties surface. The endless cable guiding elements comprise guiding pulley-wheels of substantially vertical axes forming return pulleys at the endless cable forward and rear turning ends for introducing under the ties the cable return strand which passes beyond the end of the ties and the guiding pulley-wheels with vertical symmetrical plane carried by "C"-shaped arms passing outside the tie ends the portion of the "C"-shaped arms situated above the rails being preferably integral with a roller running on the rail.

An embodiment of the present invention will now be described in more detail with reference to the accompanying drawings wherein.

Figure 1:
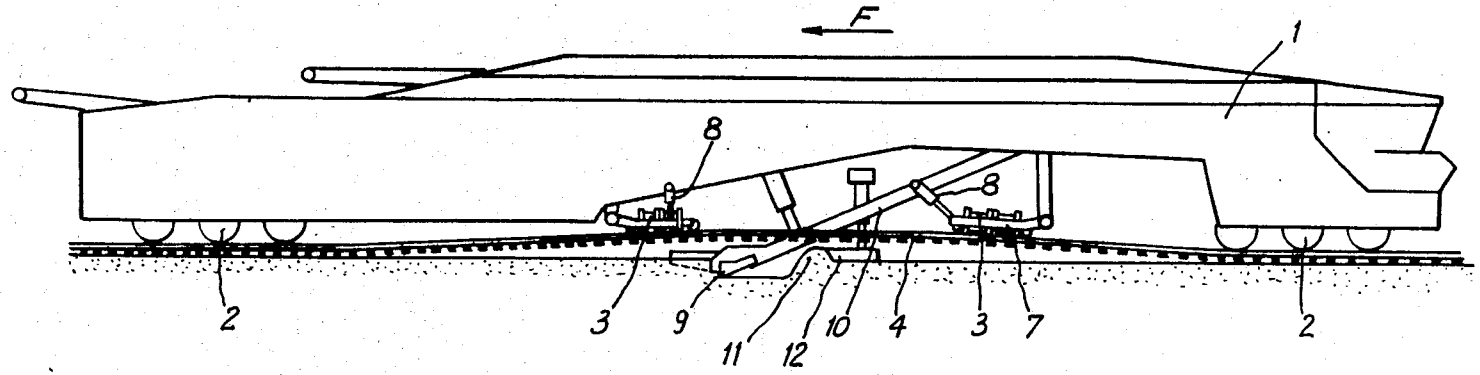
FIG. 1 is a schematic lateral elevation view of the whole ballast cleaning and levelling machine according to the invention.
Figure 2:
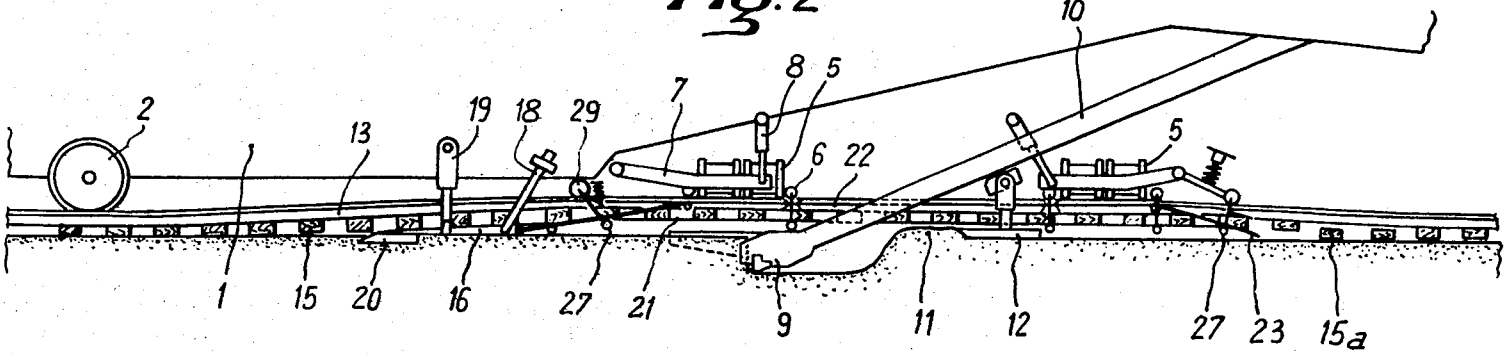
FIG. 2 is a lateral elevation view on an enlarged scale of the part of the machine of FIG. 1 which the invention concerns.
Figure 3:
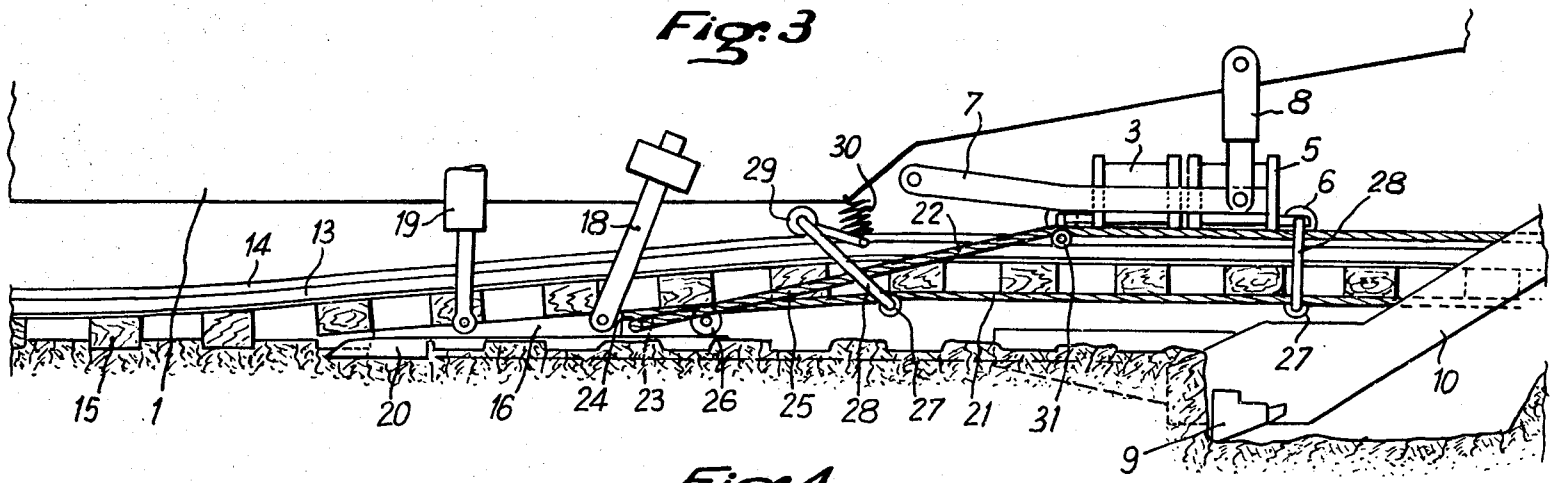
FIG. 3 is a lateral elevation view on an enlarged scale of the forward part of the device.
Figure 4:
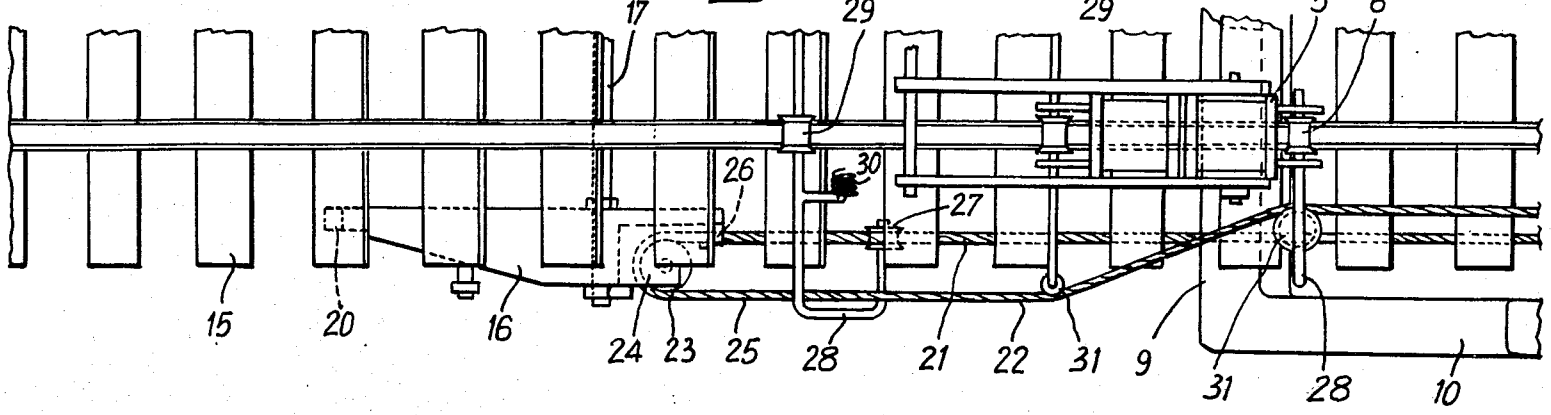
FIG. 4 is a plan view of the same.

The machine according to the invention comprises a frame 1 carried at both ends by bogies 2. This machine comprises devices 3 which lift part 4 of the railroad situated between the two bogies. The device 3 are of the electro-magnetic type and comprise electro-magnets 5 carried by rollers 6 which run on the rail and maintain the electro-magnets 5 slightly apart from said rail. The devices 3 are carried by lever-arms 7 and jacks 8 that depend from frame 1. Under the lifted part of the track is engaged a transverse excavator 9 which removes part of the ballast layer up to a certain thickness and brings up the extracted ballast through channels 10 onto a conveyor and screener assembly, the good ballast being re-deposited at 11 in front of a levelling device 12 also engaged under the track lifted part.

The electro-magnet devices 3 may be replaced by tongs comprising two rollers which cooperate with both sides of rail 13 under the head 14 of said rail.

In either case, the problem involved is to be certain that ties 15 are lifted at the same time as rail 13. Such a problem is not encountered on tracks where the fixation is provided by sleeper-screws, but exists on the contrary when the fixation is provided by spikes or nails.

According to the invention, a shoe is provided under the railroad in front of excavator 9 and lifting device 3, said shoe being engaged under the ties and having a wedge-shaped cross-section in order to lift ties 15. The shoe might occupy the railroad full width but in fact its object is substantially to lift ties 15 for engaging under their ends a member preventing them from moving away from rails 13. Preferably, the shoe comprises therefore, as illustrated, two shoe elements 16 placed under the tie ends which may be connected by drawrods such as at 17 and which are carried and pushed from frame 1 by struts 18 or jacks 19. Said shoes may, in order to reduce their braking effect, be set for sliding on the upper surface of the ballast layer, but then and due to the fact that the ties are, as shown, at least slightly embedded in the ballast layer, it is useful to provide in the forward part of the shoe 16 at least one tooth 20, the point of which passes under the lower surface of the ties.

It is apparent that the ties 15 rub on the upper surface of shoe 16 and they may support this friction without displacement in relation to the rails due to the anti-creeping device with which they are provided. In case of necessity, the surface of the shoe inclined plane may be provided with rollers.

The object of shoe 16 is substantially to provide engagement under the ties of the forward end of a support provided by the run 21 of an endless cable 22. This engagement is ensured, in the embodiment shown, by a return pulley 23, the groove plane of which is slightly inclined and which is mounted under a wing 24 extending from shoe 16 towards the rear so that the lateral outside edge of its groove overlaps the shoe or at least the ties whereas the inside edge of the groove is under the ties. In such manner, the cable outer run 25 which is brought beyond the tie ends by guiding means which will be described hereafter is engaged under the tie ends. Pulley 23 could be replaced by two pulleys with parallel axes. The active run 21 of the cable must then be guided in relation to the upper surface of the rail in order to support the ties. It should be noted that cable run 21 is not displaced in relation to the ties and it is sufficient that its deflection be less at all points than the engaging length of the connecting spikes in the ties so that the ties 15 do not risk displacement in relation to the rail. It is also desirable that cable run 21 does not bear on excavator 9 and on levelling blade 12. In this respect, cable run 21 is supported by guiding rollers 26 and 27. Rollers 26 are rollers with a horizontal axis carried by the vertical rear wing of shoe 16 and their object is to apply run 21 against the ties while preventing it from escaping from the groove of pulley 23. Rollers 27 are carried by "C"-shaped arms 28 which pass outside of tie ends 15. These "C"-shaped arms 28 may be carried by frame 1 but generally it is simpler to suspend them from rollers such as 29 which bear on the rail upper surface, the role of said rollers 29 being played by rollers 6 of the lifting devices 3. Arms 28 may comprise resilient elements between rollers 27 and rollers 29 or be resiliently biased by springs 30.

The return run 25 of the endless cable is also guided by rollers 31 in order to make it run inside in relation to channels 10. At the rear of the machine, cable 22 is guided in a similar manner with the difference that there is no shoe. If at this point a tie such as 15*a* falls by being separated from the rail, it remains exactly in its original position under the rail and the nails will be driven in again during the passage of bogie 2.

Generally, the upper or return run of cable 22 need not be driven, but if it is desired to drive it, it is sufficient to roll it in the suitable direction around a pulley integral of the the rotation of a roller 29 and with same diameter, since this cable run moves forward at a speed which is double the forward speed of the machine. It is also possible to provide on cable 22 tension devices of any known type.

The hereabove described embodiment is just an example and is adapted to receive many modifications.

I claim:

1. A ballast cleaning and levelling machine for railroad tracks comprising at least a track lifting device which lifts the rail and ties by acting on the rails, said machine carrying in front of the lifting device as such a shoe which is at least engaged under the end of the ties between a point which is exterior but neighboring the end of the tie and a point situated inside in relation to said end, the shoe having a wedge-shaped vertical cross-section and a forwardly downwardly inclined upper surface that engages the underside of the ties to lift the ties, said shoe being carried by elements which are integral with the machine frame and extend beyond the tie ends, an endless cable and a guiding device for said endless cable comprising front and rear guiding means for respectively introducing one of the cable runs, from the outside of the tie ends, behind the shoe and extracting the other end of the cable run from under the ties downstream of the lifting device and guiding means for maintaining the cable run between its introduction and its extraction, under the ties, at a distance from the upper surface of the rail which is substantially equal to the sum of the rail height and the ties thickness.

2. A ballast cleaning and levelling machine for railroad tracks as claimed in claim 1 in which the shoe is formed of two lateral elements engaging each under one tie.

3. A ballast cleaning and levelling machine for railroad tracks as claimed in claim 1, said front and rear guiding means comprising pulley-wheels disposed in substantially horizontal planes.

4. A ballast cleaning and levelling machine for railroad tracks comprising at least a track lifting device which lifts the rail and ties by acting on the rails, said machine carrying in front of the lifting device as such a shoe which is at least engaged under the end of the ties between a point which is exterior but neighboring the end of the tie and a point situated inside in relation to said end, an endless cable and a guiding device for said endless cable comprising front and rear guiding means for respectively introducing one of the cable runs, from the outside of the tie ends, behind the shoe and extracting the other end of the cable run from under the ties downstream of the lifting device and guiding means for maintaining the cable run between its introduction and its extraction, under the ties, at a distance from the upper surface of the rail which is substantially equal to the sum of the rail height and the ties thickness, the endless cable guiding elements comprising guiding pulley-wheels of substantially vertical axes forming return pulleys at the endless cable forward and rear turning ends for introducing under the ties the cable return run which passes beyond the end of the ties and the guiding pulley-wheels with vertical symmetrical plane carried by "C"-shaped arms passing outside the tie ends, the portion of the "C"-shaped arms situated above the rails being supported by a roller running on the rail.

* * * * *